US007337036B2

(12) United States Patent
Pedrini et al.

(10) Patent No.: US 7,337,036 B2
(45) Date of Patent: Feb. 26, 2008

(54) THREE-WAY CONNECTOR FOR CONNECTING WEFT FEEDERS OF TEXTILE MACHINES TO A SERIAL BUS, AND A CONTROL SYSTEM BASED THEREON

(75) Inventors: Giovanni Pedrini, Leffe (IT); Luca Gotti, Albino (IT); Mauro Varischetti, Cazzano Sant'Andrea (IT)

(73) Assignee: L.G.L. Electronics S.p.A., Gandino (IT)

( * ) Notice: Subject to any disclaimer, the term of this patent is extended or adjusted under 35 U.S.C. 154(b) by 493 days.

(21) Appl. No.: 10/886,578

(22) Filed: Jul. 9, 2004

(65) Prior Publication Data

US 2005/0026507 A1 Feb. 3, 2005

(30) Foreign Application Priority Data

Jul. 29, 2003 (IT) ..... TO2003A0585

(51) Int. Cl.
*G06F 19/00* (2006.01)

(52) U.S. Cl. ..... 700/141; 700/140; 139/116.1; 66/125 R; 710/110

(58) Field of Classification Search ..... 700/130, 700/140, 141, 142, 144; 139/116.1, 117, 139/212, 232 C, 246, 256 R, 450, 452, 453, 139/435.1, 435.2, 435.3, 435.4, 435.5, 435.6; 66/125 R, 126 R, 127, 128, 129, 231, 232, 66/238; 710/110

See application file for complete search history.

(56) References Cited

U.S. PATENT DOCUMENTS

| | | | | |
|---|---|---|---|---|
| 4,574,353 | A * | 3/1986 | Hellstrom et al. | 700/141 |
| 4,595,039 | A * | 6/1986 | Tholander | 139/435.2 |
| 5,246,039 | A * | 9/1993 | Fredriksson | 139/452 |
| 5,285,821 | A * | 2/1994 | Fredriksson | 139/452 |
| 5,323,324 | A * | 6/1994 | Fredriksson | 700/130 |
| 5,446,846 | A * | 8/1995 | Lennartsson | 710/100 |
| 5,838,570 | A * | 11/1998 | Barea | 700/143 |
| 6,815,915 | B2 * | 11/2004 | Hellstroem | 318/34 |
| 6,999,837 | B2 * | 2/2006 | Rundberg et al. | 700/143 |
| 7,110,846 | B2 * | 9/2006 | Hellstroem et al. | 700/130 |
| 2004/0095087 | A1 * | 5/2004 | Hellstroem | 318/270 |
| 2004/0238060 | A1 * | 12/2004 | Hellstroem et al. | 139/2 |
| 2005/0204781 | A1 * | 9/2005 | Rundberg et al. | 66/64 |

* cited by examiner

*Primary Examiner*—Gary L. Welch
*Assistant Examiner*—Nathan E Durham
(74) *Attorney, Agent, or Firm*—Modiano & Associati; Albert Josif; Daniel J. O'Byrne

(57) ABSTRACT

The three-way connector comprises a first, a second and a third gates directly connected to one another. The first and second gate are pluggable onto respective spans of a bus, and the third gate is connectable to a weft feeder. The three-way connector further comprises a permanent memory containing an identifying code for the associated weft feeder. A managing unit drives a serial bus to which a plurality of weft feeders are connected. The serial bus comprises the cable spans, serially connected to one another through the first and second gates of the connectors, the weft feeders being connected to respective third gates of the connectors.

6 Claims, 3 Drawing Sheets

-- PRIOR ART --

THREE-WAY CONNECTOR FOR CONNECTING WEFT FEEDERS OF TEXTILE MACHINES TO A SERIAL BUS, AND A CONTROL SYSTEM BASED THEREON

The present application claims priority to Italian Patent Application No. TO2003A000585, which was filed on Jul. 29, 2003.

This invention is concerned with a three-way connector for connecting a serial bus with a weft feeder for textile machines, particularly knitting machines, and with a weft feeder control system that is implemented by means of the connector.

BACKGROUND OF THE INVENTION

In modern textile machines, a plurality of weft feeders are slave to a master managing unit, from which they receive individual control signal or programming signals for individual parameter, and to which they transmit information signals concerning the state of the machine or process variables. This bidirectional conversation has typically taken place via a star connection between the managing unit and the individual weft feeders, and the connection, as a rule, has used differential-type buses, say according to standards RS485 or CAN.

As the number of slave weft feeders increases (which number in large machines may reach and exceed a hundred), the number of cables in the star connection increases proportionally, thereby also increasing the bulk of the cable bundles and making it difficult to neatly arrange them. This situation not only imparts an unpleasant look to the machines, but also may hinder the operation of the personnel.

Moreover, with the above arrangement the cables will have variable lengths, depending on the distance of the weft feeder from the master unit cabinet, and the manufacturer of the weft feeders will therefore have to stock a wide range of cable lengths.

Further, as persons skilled in the art will appreciate, a long cable may create problems due to the reflections of the signal traveling on the bus, and this circumstances places serious limits to the bandwidth, i.e. to the signal transmission speed along the bus.

Another and even more serious drawback of the star-connected bus distribution on machines having a large number of weft feeders concerns the addressing of the receivers of the respective weft feeders. In the conventional arrangement for addressing the receivers (which are permanently connected to the bus) the electronic card of each weft feeder houses an electric resistance whose value is unique for that receiver; the resistance is measured and compared with the address associated to the signal received via the bus. However, the analog character of this approach is only suitable for addressing half a score weft feeders.

SUMMARY OF THE INVENTION

It is now the main object of the invention to provide a three-way connector making it feasible to set up a control system for weft feeders of a textile machine, particularly a knitting machine, which system will eliminate the above drawbacks and overcome the above limitations.

More particularly, it is the aim of the invention to provide a control system by which several hundreds weft feeders can be addressed without error, while the bulk of the system cables is reduced and the signal bandwidth is increased.

It is another aim of the invention to provide a three-way connector by means of which the above control system may be set up easily and conveniently.

The above and other objects and advantages, such as will appear more clearly below, are achieved by means of a connector having the features recited in claim 1 and a control system having the features recited in claim 4.

The dependent claims set forth other advantageous, though unessential, features of the invention.

BRIEF DESCRIPTION OF THE DRAWINGS

The invention will now be described in more detail with reference to a preferred, though not exclusive, embodiment, shown by way of illustrative and not limiting example in the attached drawings, wherein.

DESCRIPTION OF PREFERRED EMBODIMENTS

Figure 1:
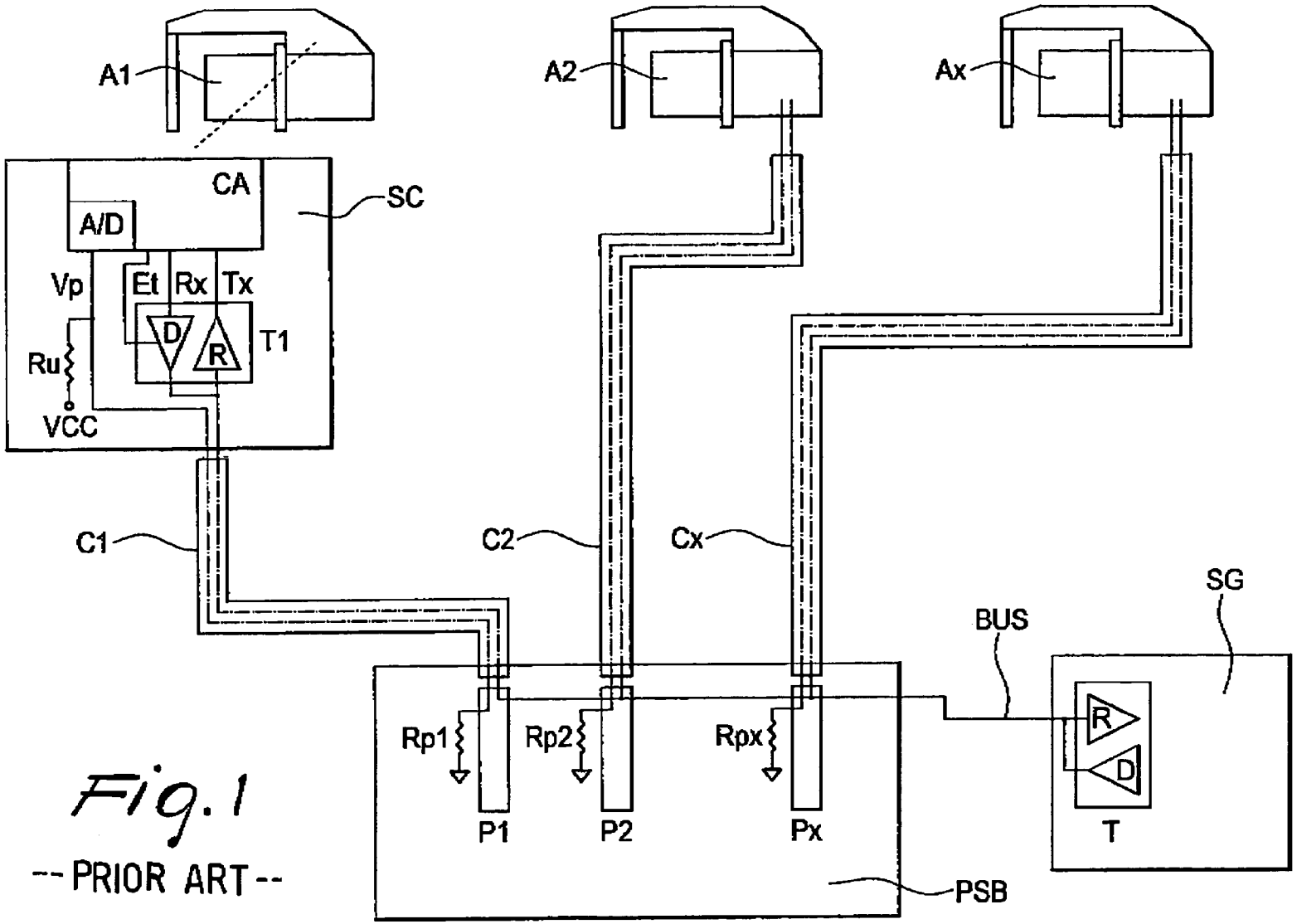
FIG. 1 is a simplified diagram of a control system for weft feeders in a textile machine, according to the prior art.

With reference to FIG. 1, in a system of the prior art a plurality of weft feeders of a textile machine, such as A1, A2, Ax, are connected by respective connection cables C1, C2, Cx to a distribution box PBS and from there to a master managing unit SG for the machine, via a bidirectional serial differential bus BUS, typically RS485 or CAN Bus. Within managing unit SG, bus BUS leads to a receiver R and to a driver D. Within box PBS, the bus forks out in star-fashion to cables C1, C2, Cx, via respective connectors P1, P2, Px leading to respective electronic cards of weft feeders A1, A2, Ax; for simplicity, only a card SC for weft feeder A1 is shown. Card SC typically includes a microcontroller CA managing the so-called transceiver T1 comprising a receiver R for receiving serial digital signals from the bus and transferring them as Tx to microcontroller CA, and a driver D for receiving signals Rx from CA and transmitting them onto the bus. Usually, an enabling signal Et is also present, having the purpose of avoiding that two or more drivers simultaneously drive the bus, although on CAN buses a different arrangement for the avoidance of such collisions is available (standard ISO 11898).

Beside bus BUS (typically two wires, but for simplicity only one wire is shown on FIG. 1), cables C1, C2, Cx also generally house respective electric-supply conductors (not shown) for the weft feeders, and also respective connection conductors between electric resistances Rp1, Rp2, Rpx within box PBS having a grounded end, on the one hand, and respective resistances such a Ru on the cards of weft feeders A1, A2, Ax. Resistances Rp1, Rp2, Rpx each have a unique value identifying a respective weft feeder. Card SC is provided with an analog/digital converter A/D, connected to a middle tap Vp of a voltage divider comprising resistance Ru on the card and resistance Rp in box PBS; by measuring voltage Vp, microcontroller CA can therefore compute the value of resistance Rp and therefore its associated address.

The resolution of this addressing method, as will be apparent to persons skilled in the art, is drastically limited by several factors, such as the measuring accuracy and drift of the voltage drop along the conductors, etc. In practice, less than a score nodes can be coded with this arrangement (typically up to 16), which are sufficient for weaving application but insufficient for knitting, where there may be up to 200 weft feeders on the same machine.

Figure 2:
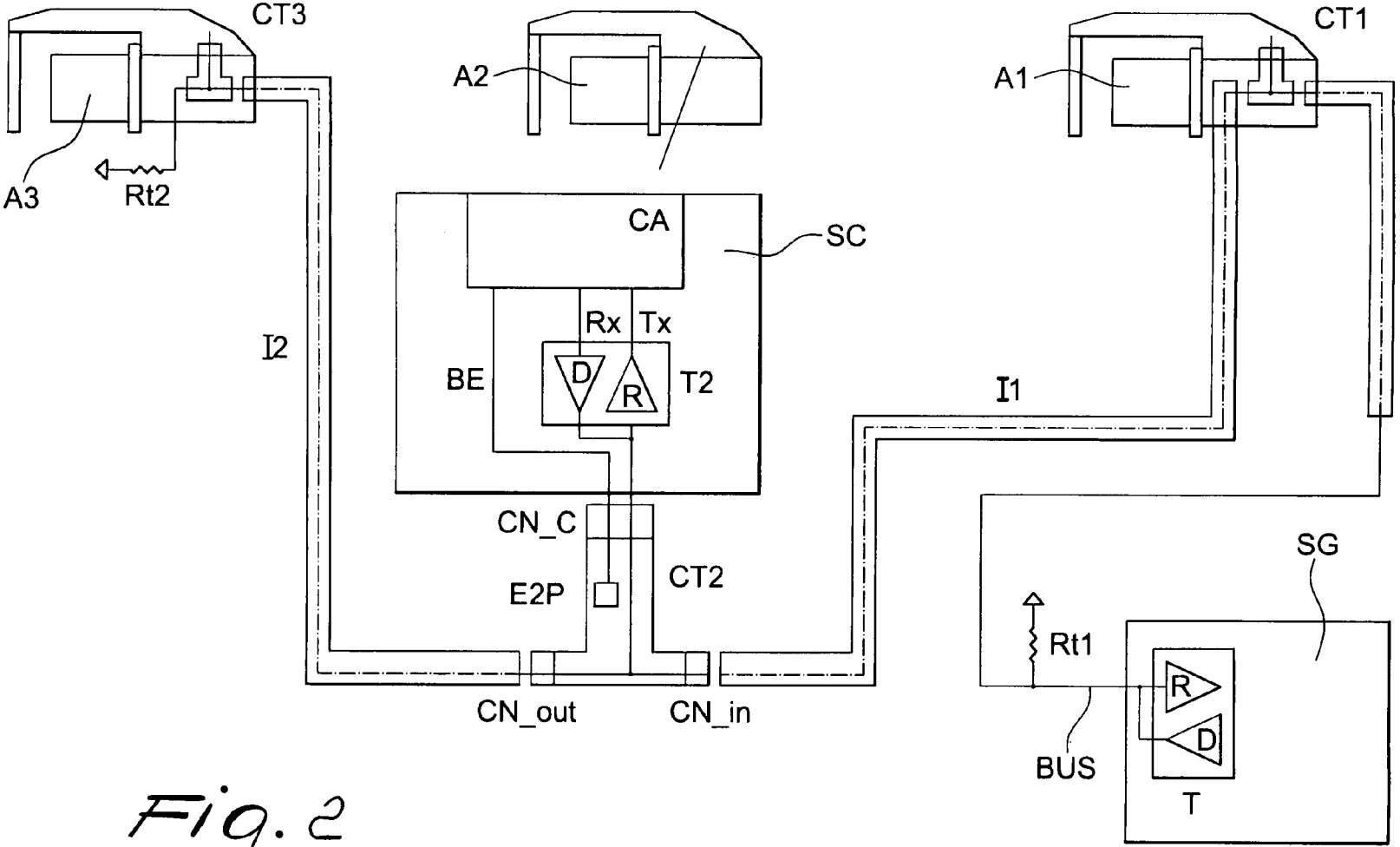
FIG. 2 is a diagram similar to FIG. 1, but showing a control system according to the invention and using T-connectors according to the invention.

In order to overcome the above limitations, the invention provides a control system as shown on FIG. 2, where several weft feeders A1, A2, A3 are provided with respective electronic cards, of which only card SC of weft feeder A2 is shown. Card SC is identical to card SC. of FIG. 1, except that, instead of an analog/digital converter, it is provided with a digital input BE (parallel or serial) to microcontroller CA.

The system further includes a managing unit SG, identical to the corresponding unit of FIG. 1, which drives a differential serial bus BUS, leading to cables 11, 12, which are linearly connected as described below.

According to the invention, the cards are provided with respective three-way connectors CT1, CT2, CT3, which are structurally identical to one another, so that only connector CT2 is shown in detail. Connector CT2 is provided with two gates CN_in and CN_out, connected to each other and respectively pluggable to an upstream cable span I1 and to a downstream cable span I2, and also with a cross-gate CN_C, which is T-connected to gates CN_in and CN_out, for connection to transceiver T2 of card SC. Further, connector CT2 is provided with a programmable memory E2P, which is connectable to the input BE of microcontroller CA via a connection by parallel or serial bus, which is part of gate CN_C.

Preferably, the entire linear bus of managing unit SG leading to the last weft feeder A3 is terminated at its two opposite ends by termination resistances Rt1 and Rt2, in order to avoid mismatching and reflection, and to allow higher transmission speeds to be used, at least 100 Kbit/sec for an overall bus length of 200 meters.

In order to provide an addressing function, memory E2P of each connector is programmed with a value corresponding to the address of the associated card.

While not shown on FIG. 2, it falls within the realm of embodiments of the invention that the cable spans I1, I2 also incorporate the electric supply for the weft feeders; in this case, the connectors CT1, CT2, etc. will also include connections for forwarding such supply.

It will be appreciated that, with the above disclosed arrangement, a single linear bus connects all the weft feeders, with drastic reduction of the cable bundles, while, at the same time, the digital addressing scheme allows hundreds of addresses to be resolved without error.

The three-way connectors of the invention may be manufactured and stocked in a generic form, and be programmed with the desired addresses at the time of installation, preferably providing them with labels showing the addresses.

Figure 3:
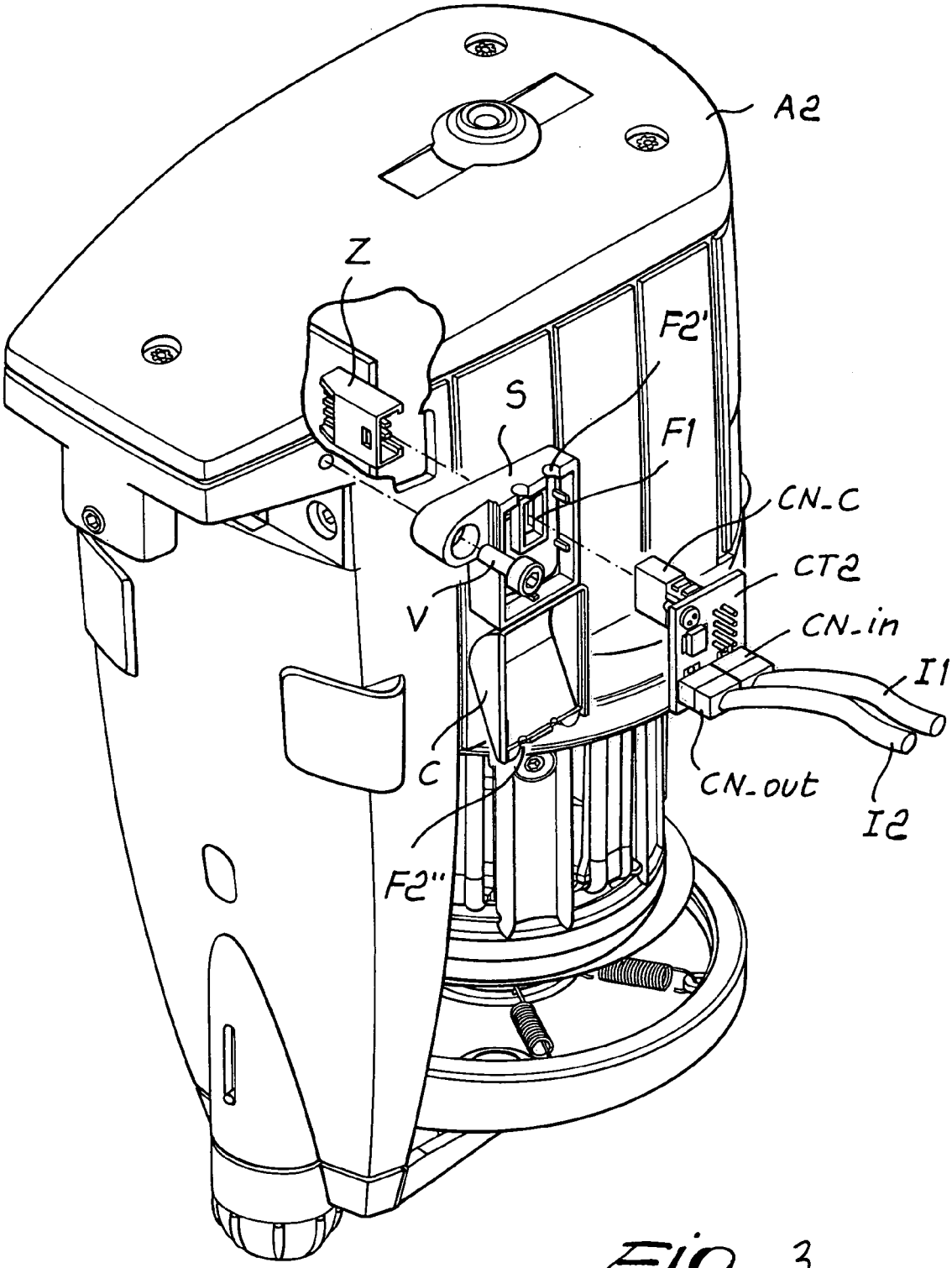
FIG. 3 is a perspective view of a weft feeder connected to a control bus via a three-way connector according to the invention.

FIG. 3 shows, in a partly exploded perspective view, a conventional weft feeder A2 and a three-way connector CT2 according to the invention. Connector CT2 is housed in a box S fastened to the housing of the weft feeder by a fastening screw V. The bottom of box S has a slot F1 for allowing gate CN_C to be inserted and plugged into an electrical connection socket Z that is a part of weft feeder A2.

Box S and its cover C are shaped with respective semi-cylindrical recesses F2' and F2", to allow passage of cables I1 and I2 of gates CN_in and CN_out.

Obviously, the embodiments of the invention as disclosed above may be further modified, within the inventive idea as defined in the attached claims.

The disclosures in Italian Patent Application No. TO2003A000585 from which this application claims priority are incorporated herein by reference.

What is claimed is:

1. A three-way connector for connecting weft feeders of textile machines to a serial bus, comprising a first, a second and a third gates directly connected to one another, the first and second gate being pluggable onto respective spans of the bus, and the third gate being connectable to a weft feeder; and a permanent memory containing an identifying code for the associated weft feeder wherein the three-way connector is housed in a box which is fastened to a housing of the weft feeder and which comprises a cover, the bottom, of the box having a slot for allowing said third gate to be inserted and plugged into an electrical connection socket that is a part of the weft feeder, the box and its cover being shaped with respective semi-cylindrical recesses to allow passage of cables of said first and second gates.

2. The three-way connector of claim 1, wherein said permanent memory is an electrically programmable memory.

3. The three-way connector of claim 1, wherein the gates of the connector further comprise a pair of conductors for the electric supply to the weft feeder.

4. A control system for weft feeders, comprising a managing unit driving a serial bus to which a plurality of weft feeders are connected, wherein said serial bus comprises:

cable spans serially connected to one another through the first and second gates of a plurality of connectors according to claim 1, and said weft feeders are connected to respective third gates of said connectors.

5. The control system of claim 4, wherein said serial bus is a differential bus.

6. The control system of claim 4, wherein the opposite ends of said serial bus are terminated by respective termination resistances.

* * * * *